United States Patent [19]

Rossi

[11] Patent Number: 4,747,250

[45] Date of Patent: May 31, 1988

[54] MACHINE MANUFACTURING PAPER BAGS CONTAINING SOME SUBSTANCE TO PREPARE INFUSIONS OR INFUSED BEVERAGES

[76] Inventor: Luigi Rossi, Via Alessandria 1 15055, Pontecurone (Alessandria), Italy

[21] Appl. No.: 929,680

[22] Filed: Nov. 10, 1986

[30] Foreign Application Priority Data

Nov. 11, 1985 [IT] Italy ..... 23784/85[U]

[51] Int. Cl.[4] ..... B65B 31/00

[52] U.S. Cl. ..... 53/511; 53/528; 53/553; 53/559

[58] Field of Search ..... 53/122, 523, 433, 528, 53/434, 553, 436, 561, 453, 551, 511, 517

[56] References Cited

U.S. PATENT DOCUMENTS

| | | | |
|---|---|---|---|
| 3,045,404 | 7/1962 | Wilson | 53/551 |
| 3,218,776 | 11/1965 | Cloud | 53/453 |
| 3,481,283 | 12/1969 | Vogt | 53/122 |
| 4,048,785 | 9/1977 | Wright | 53/122 |
| 4,366,663 | 1/1983 | Grebe | 53/561 X |
| 4,437,294 | 3/1984 | Romagnoli | 53/122 X |
| 4,571,924 | 2/1986 | Bahrani | 53/453 |
| 4,594,066 | 6/1986 | Graham | 53/122 X |

FOREIGN PATENT DOCUMENTS

| | | | |
|---|---|---|---|
| 1444527 | 5/1966 | France | 53/453 |

*Primary Examiner*—Robert L. Spruill
*Assistant Examiner*—Steven P. Weihrouch
*Attorney, Agent, or Firm*—Helfgott & Karas

[57] ABSTRACT

Machine for packaging paper pockets or bags containing substances used in infused beverages comprising a plurality of cup or pan-like devices, having a central depression, on which bears a first or lower paper ribbon or web receiving measures or doses or said substance, e.g. in powdered form, metering means to supply said measures to said paper ribbon, tamping means to tamp said substance and means to apply and seal a second paper ribbon on said first paper ribbon closing said substance measures in pockets or bags so-formed.

6 Claims, 3 Drawing Sheets

MACHINE MANUFACTURING PAPER BAGS CONTAINING SOME SUBSTANCE TO PREPARE INFUSIONS OR INFUSED BEVERAGES

BACKGROUND OF THE INVENTION

The present invention relates to a machine for packaging filter paper pockets or bags containing substances powdered or in the form of small leaves for the preparation of infusions.

More specifically the present invention relates to a machine for the packaging of filter-paper pockets containing a tablet of fresh coffee powder, the pockets in question being joined together to form a strip or continuous ribbon which feeds intermittently an infusion unit of the usual type for the preparation of expresso coffee.

These machines for the preparation of expresso coffee are known and have acquired widespread use especially in the form of automatic distributors operated by coins or tokens. Machines are also known for packaging continuous strips of paper which have at regular intervals filter pockets containing freshly ground coffee.

These machines consist essentially of a traversing table, a lower ribbon of paper on which are formed at regular intervals recesses in which is deposited a predetermined amount of coffee powder which is deposited in the form of a tablet. On this lower ribbon there is superimposed an upper ribbon of paper which covers the individual tablets of fresh coffee powder, after which the two superimposed ribbons are welded, e.g. by thermosealing, along the entire periphery of each measure or tablet of fresh coffee powder.

An example of said machines for the packaging of strips of paper having at regular intervals filter pockets containing fresh ground coffee is described and claimed in the Italian application for utility model No. 23186-B/84 filed Sept. 18, 1984 by the same applicant as of the present application.

Said invention consists of a machine for the packaging of said pockets or bags of filter paper containing a measure of the substance from which the infusion is to be made, said machine comprising a conveyance table on which there advances in steps a plurality of jaw devices having a jaw moving between an open position and a closed position in relation to a fixed jaw, said table being arranged beneath a series of processing devices comprising first means of forming lower cavities in the lower paper ribbon fed upstream on said lower jaw, a metering device for the fresh coffee powder, a pressing member for the measure of coffee powder deposited on lower paper ribbon advancing intermittently, means of feeding and positioning the upper layer of paper of said pocket, and thermosealing means, said jaw devices comprising magnetically controlled means tending to hold said moving jaw closed against said fixed jaw while between said fixed jaw and said moving jaw is interposed said lower or supporting paper ribbon and with said moving jaw there is integral a drive pin engaged by cam means which drive the moving jaw between the open and closed position.

The machine described in the abovementioned application operates in a decidedly satisfactory manner but there remains a certain complexity of operation linked to said jaw devices operating between an open and a closed position and the need of having a very long chain of said jaw devices because of the various phases of the preforming of the lower ribbon, metering and pressing of the powder, feeding, positioning and forming of the upper ribbon, and thermosealing of the two ribbons performing in succession in distinct and contiguous stations or members of said machine.

An object of the present invention is to provide an improved machine for the packaging of filter pockets or bags of the abovementioned type and, in particular, a mechanism without jaws which would however permit holding firmly said first paper strip during the various pocket forming operations.

Another specific object of the present invention is to shorten as much as possible the chain formed of cups without jaws, using a tool which performs simultaneously with a single action the highest possible number of operations.

Another object of the present invention is to press the powder designed to fill said pockets in such a manner as to form a layer of the most uniform thickness possible.

Finally, another specific object of the present invention is to return all the coffee powder particles to within the layers forming the pockets in such as a manner as to eliminate all scattering of powder and hence the formation of defective pockets.

SUMMARY OF THE INVENTION

The above objects are essentially achieved by a machine for packaging filter paper pockets or bags containing a measure of the substance with which the infusion is to be made, said pockets being joined to from a continuous strip of paper, said machine comprising a conveyance table on which there advances in steps a plurality of flat cuplike devices formed of an essentially quadrangular plate having a central depression with rounded edges similar to a tray which follow the shape of the pocket to be formed, said depression having a bottom with holes connecting to a vacuum device, said device advancing under a unitary mould formed of several operating stations driven simultaneously which together perform the following operations. (1) Performing in the lower filter-paper ribbon of a recess conforming to the depression of the flat cup devices, (2) filling of said recesses with a measure of powder, (3) tamping of said measure by means of a tamper having the purpose of evening the measure and detaching it completely from a device conveying said measure in the filling position, (4) removal by means of vacuum beneath the cup devices of all particles of powder tending to disperse for the purpose of collecting them on the tamped measure in the recess of the lower sheet of the filter paper. The flat cup devices as they continue to advance emerge from under the unitary mould to the first position where they receive a second filter- paper ribbon superimposing itself on the first ribbon in such a manner as to form the complete pocket or bag which is conventionally welded in a subsequent position by the action of a heated plate in accordance with a method of the prior art described, e.g. in the abovementioned utility model application.

More specifically, the abovesaid packaging machine comprises a rotary measure-conveyance device formed of a disc of appropriate thickness having openings passing from face to face through the disc which rotates on an axis pivoted on an upper face of the aforesaid unitary mould in such a manner that the lower face of said disc slides in contact with said upper face of the mould, said openings acting as cavities for the conveyance of powder measure from a metering mechanism having the function of introducing in succession into each opening when it passes thereunder a quantity of powder such as to fill said openings to the edge to an opening made through the mould which puts one of the underlying flat cup devices to permit transfer of said powder from the opening of the conveyance disc to the recess in the first paper ribbon resting on the bottom of the depression of one of the cup devices.

In a preferred embodiment of the invention the disc with openings, in addition to sliding in contact with an upper face of the unitary mould, is closed at the top and sides by a cover coinciding with said unitary mould in such a manner as to eliminate all danger of dispersion of the powder by said measure conveyance device, said cover having a first opening which permits entry of the powder into one of the cavities of the disc and a second opening aligned with said opening made through unitary mould which permits passage of a tamper in the form of an overturned cup which tamps said powder. In addition, the individual flat cup devices have holes in the bottom for communication with a vacuum device to aid adhesion of the first filter-paper ribbon to the bottoms of the cup devices and to return all the powder, which tends to disperse, to the center of each measure on the ribbon.

In a still more preferred manner said vacuum under the said cup devices is suspended when the powder is made to pass from the conveyor disc to its recess on the first paper ribbon to reduce to a minimum the dispersal of powder and is resumed when the rotating tamper presses on the powder. Said stopping and resumption of vacuum can be preferably performed by a valve mechanism of the type, for example, of a rotating distribution valve connected to and synchronized with said tamper.

BRIEF DESCRIPTION OF THE DRAWINGS

The peculiar features and advantages of the present invention will appear more clearly from the following description given with reference to the annexed drawings wherein.

DETAILED DESCRIPTION OF PREFERRED EMBODIMENTS

Figure 1:
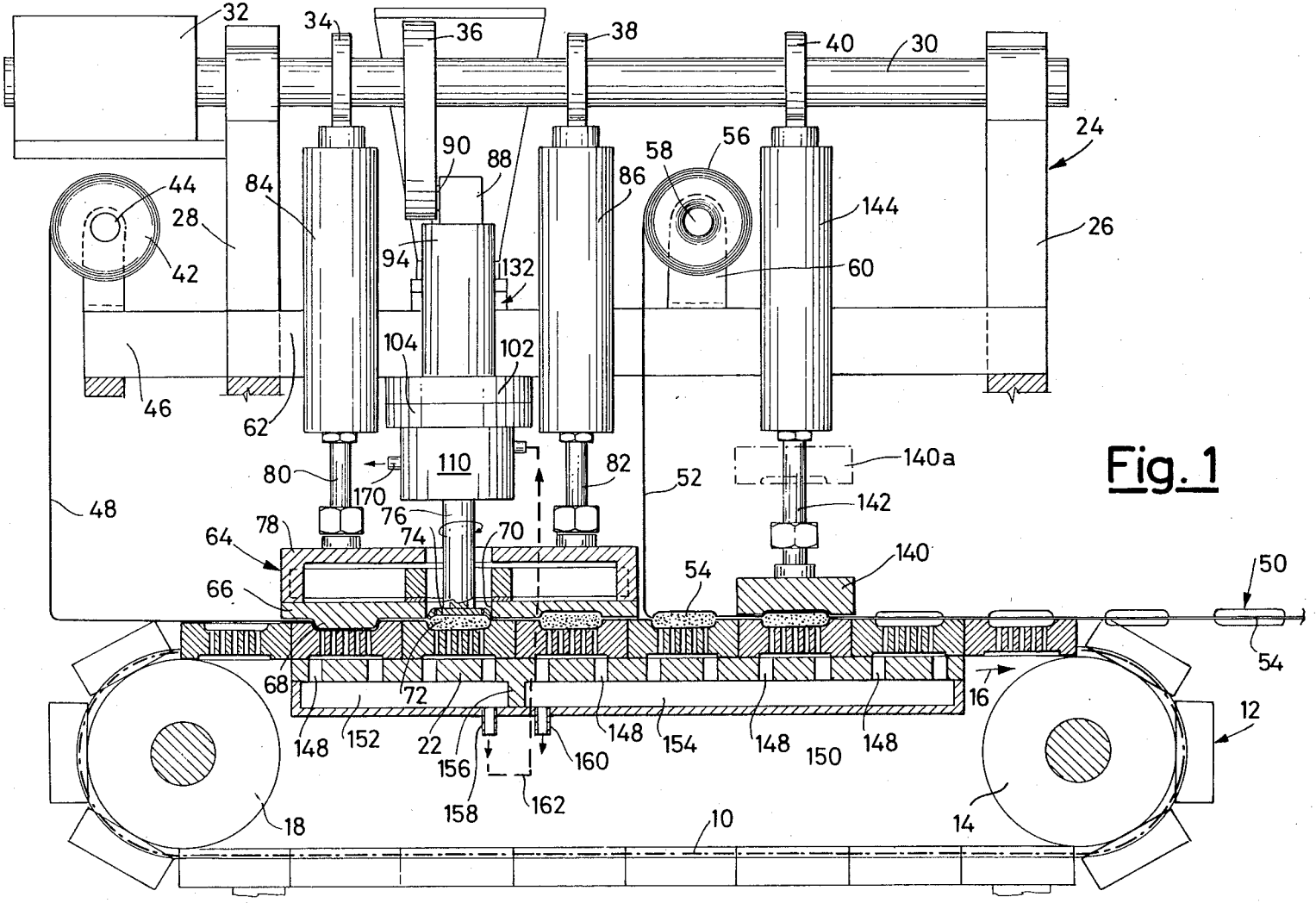
FIG. 1 is a simplified schematic overall view of the machine to which the present invention relates.
Figure 2:
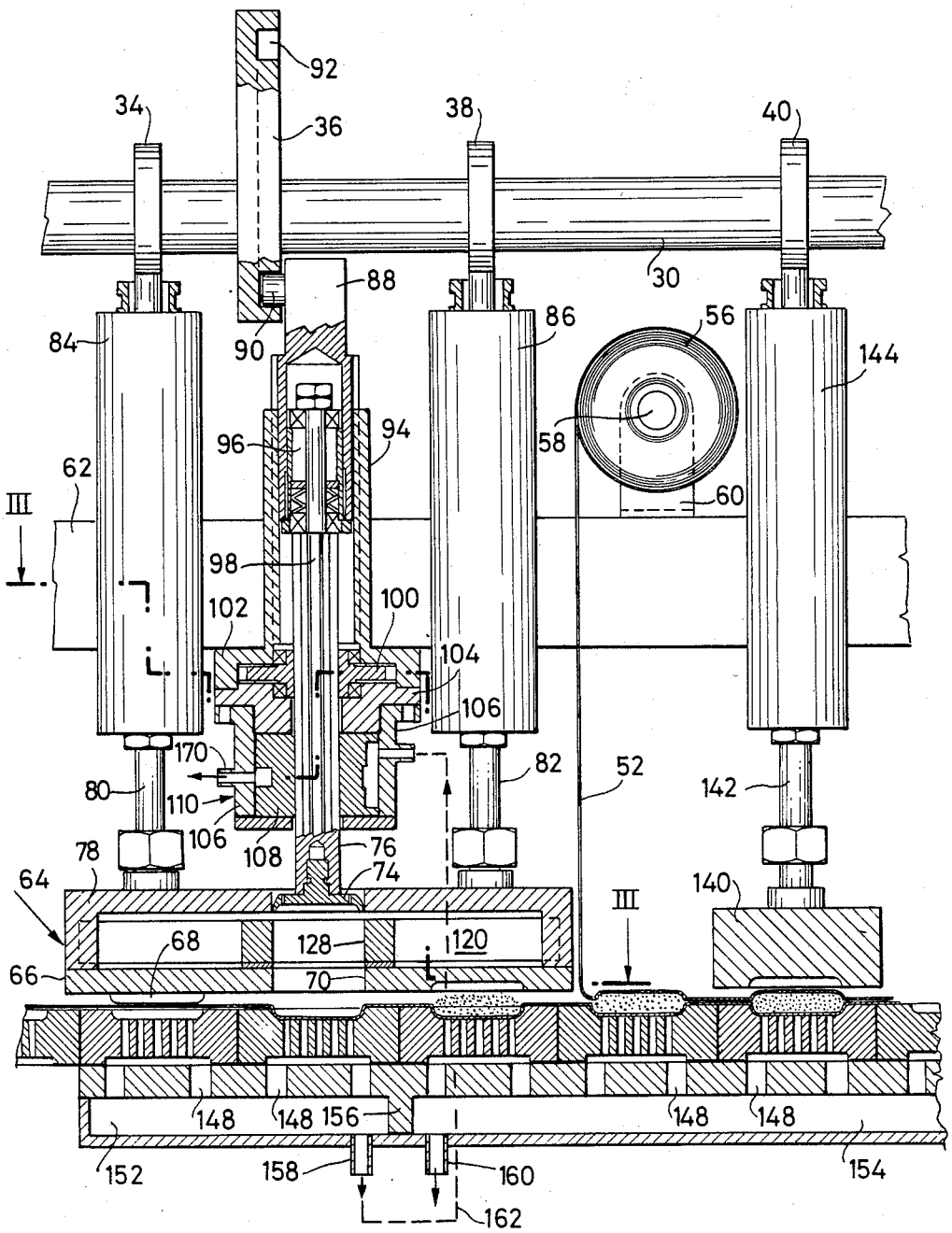
FIG. 2 is an enlarged side elevation of a complex detail of a chain with cup devices, an unitary mould and a conveyor disc of the present invention.

Referring to the drawings and in particular to FIG. 1 the machine in accordance with the invention comprises a conveyor chain 10 the links of which are formed of cup devices 12 better illustrated in FIG. 2. The conveyor chain is driven by a drive roller 14 in the direction of the arrow 16 and closes on an idling roller 18.

The operating travel of the chain 10 takes place on the supporting table shown schematically in FIG. 1 with the number 22. In this regard it should be observed that the machine shown in FIG. 1 is of an already known type and is specified for example in the above-mentioned utility model application so that, for the sake of brevity, a detailed description thereof is omitted except as specifically pertains to the cup devices and the other features forming the object of the present invention. Above the conveyor chain 10 is mounted a frame 24 presenting two uprights 26 and 28 which support in a rotating manner a cam shaft 30 driven by a reducing gear 32 and bearing a plurality of cams 34, 36, 38 and 40 for the purpose indicated below, said cams being synchronized together in relation to the operation of the various members and devices controlled thereby.

Number 42 indicates a roll of filter-paper ribbon mounted in a rotating manner on a paper-holding reel 44 which is born by a bracket 46. From the roll 42 is taken the filter-paper ribbon 48, designed to form the lower or supporting ribbon of the strip of filter pockets or bags indicated generally by number 50 at the right end of FIG. 1, each pocket 50 comprising a cavity formed by said lower filter-paper ribbon 48, of an upper or closing filter-paper ribbon 52 and of a tablet measure of fresh coffee powder 54.

The filter-paper ribbon 52 is taken from a roll 56 mounted in a freely rotating manner on a reel or mandrel 58 born by a support 60.

Now considering all the figures, it is seen that on the crosspiece 62 of the frame 24 there are mounted in order (1) a unitary mould 64 the purpose of which is to preform and fill with coffee powder the lower filter-paper ribbon, (2) a forming and sealing member 140 having the purpose of shaping and sealing the upper ribbon 52 of filter paper to the lower ribbon 48 to form a pocket 50.

The unitary mould 64 is formed of a base plate or sole 66, having a projection 68, a hole 70 for passage of measures of coffee powder 72, and a tamper 74 with an overturned cup, said tamper being supported by a shaft 76, by a cover 78, by two stems 80 and 82 integral with said cover and driven through conventional motion transmission mechanisms 84 and 86 fitted with springs to hold the stems 80 and 82 lifted against the cams 34 and 38 respectively in order to supply the mould or punch 64 with a reciprocating movement. The tamper 74 mounted on the rotating shaft 76 is driven in its reciprocating movement by a stem 88 equipped with a side protuberance or pin 90 designed to engage with a shaped groove 92 made in the cam 36 in such a manner as to permit positive engagement of said cam with the stem 88 in both directions of its reciprocating movement. Said stem 88 is fitted in a sliding manner in a sheath 94 fixed to the crosspiece 62 and is fitted in its lower part with a thrust bearing 96 designed to connect said stem 88 with the rotating shaft 76 in such as a manner as to permit it free rotation and reciprocating movement conferred by the stem 88. The shaft 76 has grooves 98 which permit axially sliding engagement with a sprocket 100 which is driven in turn by a gear assembly which will be explained in greater detail below.

The sprocket 100 is housed in a seat formed by an upper flange 102 and a lower flange 104 which is in turn fixed to a cylindrical casing 106 bearing inside a reel 108 and forming a rotating distribution valve assembly 110 having the purpose which will be explained below.

The cover 78 of the unitary mould 64 contains a member for conveyance of the coffee powder measures formed by a disc 120 traversed by the openings 122, 124, 126 designed to receive one measure of freshly ground coffee each coming from a delivery system 130 connected to known grinding means such as the means 132 shown in outline in FIG. 1.

The disc 120 is integral with a shaft pivoted in the base plate sole 66 and in the cover 78 of the unitary mould 64 and moves in steps covering angles corresponding to the distance between two adjoining openings in the disc in such a manner as to permit stopping and alignment of said openings with the system 130 which delivers coffee and with the hole 70 in the base plate 66 respectively to permit passage of the ground coffee first from the delivery system 130 to the openings in the disc and then from the openings in the disc to the hole 70 in the base plate 66 for the purpose of depositing said measure of coffee on the filter-paper ribbon 48 supported on a cup device 12.

The opening in the disc 120, as the opening 128, which at that moment is aligned with the hole 70 and with the tamper 74, is traversed by said tamper which pushes and tamps all the coffee powder on the ribbon 48. Subsequently the tamper 74 withdraws and frees the opening 128 of the disc 120 which can thus rotate to a subsequent position.

The chain 10 in its step movement following the direction indicated by the arrow 16 brings the lower ribbon 48 with the measure of tamped coffee out the unitary mould 64 to meet an upper covering ribbon 52, also of filter paper, which is superimposed on the lower ribbon 48 and is sealed therewith by a forming and sealing member 140 made up of a flat plate having tray-like recesses similar to those of the cup device 12 and heated in the conventional manner to permit thermosealing of the two filter-paper ribbons, said forming and sealing member being of a type known in the previous art.

The forming and sealing member 140 is fixed to a stem 142 which, through a motion transmission mechanism 144 fixed to the crosspiece 62, rests on the cam 40 receiving therefrom a reciprocating movement which causes the member 140 to rotate between its lower position, represented in solid lines, and an upper position 140*a* represented in broken lines. Following this forming and thermosealing station, the paper ribbon bearing the filled pockets 50 moves to subsequent stations for punching of holes or perforation of weakening zones to aid tearing as well as shearing of the individual pockets for preparation thereof in the package forms required by the market.

A particularly interesting characteristic of the present invention is provided by the support table 22 on which slides the chain 10 bearing the cup devices 12b beneath the unitary mould 64 and beneath the forming and sealing member 140. Said support table 22 is fitted underneath with ducts 148 communicating with a cover 150 divided in two compartments 152 and 154 separated by a partition 156 and communicating with two respective sources of vacuum of which the one connected with the compartment 152 operates intermittently and the one connected with the compartment 154 operates continuously. The compartment 152 is connected to a general source of vacuum through a duct 158 which, through a pipe 162, passes through the distribution valve 110 which permits vacuum only at certain times, while the compartment 154 is connected permanently through a duct 160 to said general vacuum source.

Figure 3:
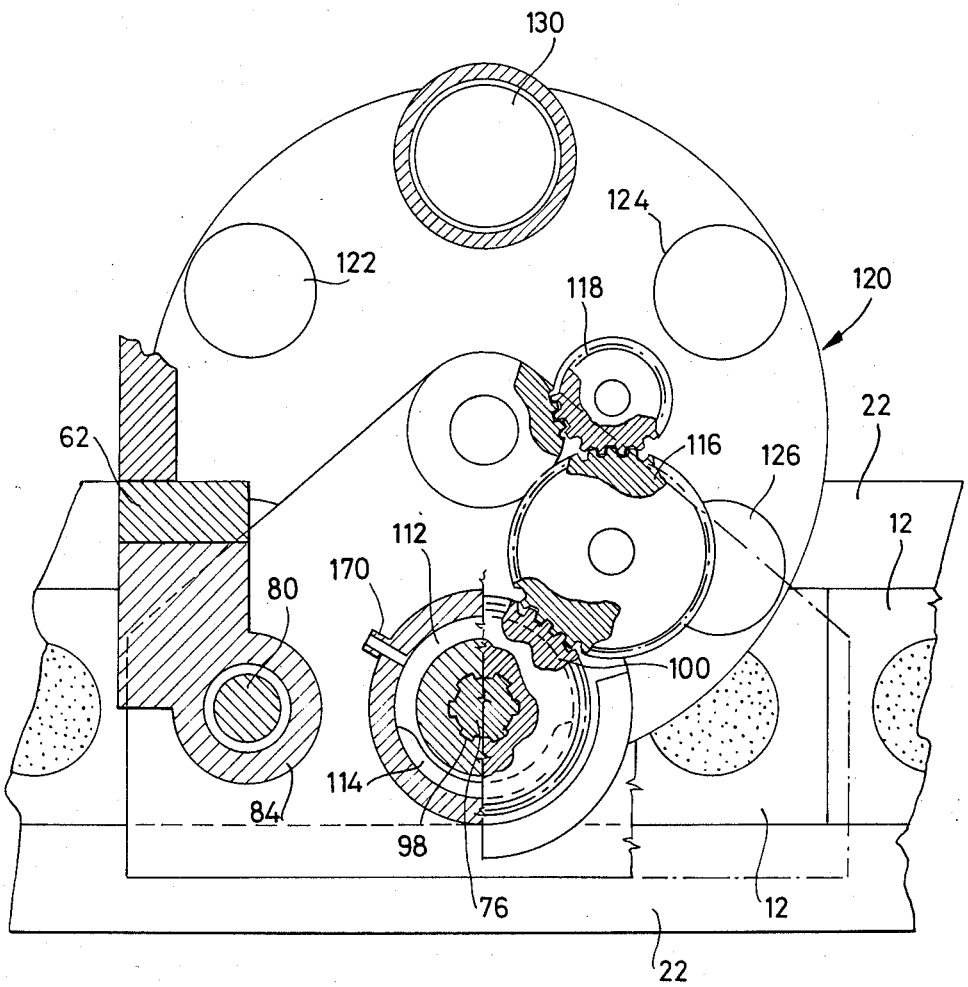
FIG. 3 is a view along line 3—3 of FIG. 2 of the unitary mould and conveyor disc assembly of the present invention.

Returning for a moment to the distribution valve 110 illustrated in FIGS. 2 and 3 and observing in particular FIG. 3 it is seen that said valve is formed of a cylindrical reel 108 rotating by means of the action of the shaft 76 within the cylindrical casing 106 with smooth interior walls which form a seal with said reel 108. Said reel has protuberances or landes 112 and lowerings or recess, such as the recess 114, which permit intermittent communication, linked with the position of the shaft 76, between a duct 170 connected with the general vacuum source and the abovesaid pipe 162 in such a manner as to apply to the compartment 152 an intermittent vacuum linked with the rotation of said shaft 76. This fact prevents the presence of vacuum when the coffee powder passes from the opening 128 of the disc 120 through the hole 70 of the unitary mould 64 on the lower ribbon 48 of filter paper since vacuum at this moment could cause dispersal and uneven tamping of the coffee powder. Since the action of the distribution valve 110 is linked to the position of the disc 120 the gear 100 is connected through an intermediate gear 116 to a drive gear 118 which provides synchronous movement of said disc 120 and of the shaft 76. Summarizing the operation of the present invention, to form the pockets 50 of coffee powder or the like a filter-paper ribbon 48 is laid on the cup devices 12 of the chain 10 which advance in steps under the mould 64 and under the forming and sealing member 140.

In the first position the ribbon 48 is performed by the vacuum of the bottom of the depressions and by the protuberance 68.

In the second position the preshaped ribbon is loaded with a measure of coffee powder 72 which is subsequently packed by the tamper 74 with overturned cup which evens completely said measure of coffee. During filling of the powder the vacuum is stopped by the distribution valve 110 to avoid dispersal and uneven tamping of said powder.

In subsequent positions the ribbon 48, bearing the load of coffee powder, is covered by the upper ribbon 52 which is subsequently welded to the lower ribbon 48 by the forming and sealing member 140 optaining thereby the pocket 50.

In subsequent positions the completed ribbon containing the pockets 50 is provided with punched side holes and/or weakening perforations to permit their use and the formation of packages desidered by the market.

The invention has been described for a machine for the preparation of strips of pockets for fresh coffee powder but only as an example because the machine may be used in an essentially similar manner for the preparation of filter bags of other infusion substances such as tea, chamomile, and the like.

What is claimed is:

1. A machine for packaging a continuous horizontal strip constituted by a lower horizontal ribbon of filter paper having recesses disposed in regularly spaced longitudinally separated position, the recesses being filled with a powdered substance, and an upper horizontal ribbon of filter paper overlying and sealed to the lower ribbon and also sealingly separated each recess with the substance sealed therein, thereby forming individual packets disposed longitudinally end to end and individually separable from the remainder of the strip, said machine comprising;

a longitudinally elongated horizontal flat table top having oppositely disposed feed and discharge ends and having longitudinally spaced vertical bores extending between top and bottom horizontal surfaces of the top;

first means to feed an endless chain horizontally along the top surface of the top in the longitudinal direction in successive like discrete steps from the feed end to the discharge end, said chain being formed by a series of longitudinally spaced like horizontally disposed links secured end to end, each link having a cup shaped recess extending downwardly from a top horizontal surface thereof and also having spaced vertical bores which extend from the bottom of the link recess to the surface of the table top, each discrete step moving the chain along a longitudinal length of a single link;

second means to feed said lower ribbon on top of the chain to cover the top horizontal surfaces of all of the horizontal links;

a first station disposed adjacent the feed end of the top and provided with a vertically elongated member which has upper and lower ends and which moving in timed relationship with the first means is first lowered from a raised position at which the lower end of the member is spaced above the ribbon into a lowered position at which the lower end presses a section of the portion of the underlying lower ribbon into the recess of the underlying link to form a recess in said lower ribbon portion and then is returned to the raised position;

a second station disposed in longitudinally spaced position between the first station and the discharge and provided with third means which operating in timed relationship with the first means fills the recess of the underlying portion of the lower ribbon with a metered quantity of said substance;

a third station disposed in longitudinally spaced position between the second station and the discharge and provided with fourth means which operating in timed relationship with the first means tamps down the substance in the recess in the underlying lower ribbon portion;

fifth means disposed in longitudinally spaced position between the third station and the discharge end to feed the top ribbon over the lower ribbon as the lower ribbon is moved longitudinally from the third station toward the discharge end;

a fourth station disposed in longitudinally spaced position between the fifth means and the discharge end and provided with sixth means to seal the overlying portion of the upper ribbon to the underlying portion of the lower ribbon and to sealingly separate each recess with the substance sealed therein to form said packets;

seventh vacuum operating means associated with the first and second stations and disposed underneath the table top, said seventh means cooperating with the vertical bores in the links and table top to assist the member by vacuum action informing the recesses in the lower ribbon and to remove any scattered substance powders, the seventh means being deactivated during each filling operation at the second station; and eighth vacuum operating means associated with the third and fourth station and the fifth means and disposed underneath the table top, the eighth means cooperating with the vertical bores in the links and table top to continuously remove scattered substance powders.

2. The machine as set forth in claim 1 wherein the third means includes a disc having spaced openings and rotated in successive discrete steps which are less than a complete revolution in such manner that an opening in the disc is aligned with the recess in the underlying portion of the lower ribbon to act as a conveying channel for passing the metered amount of substance into the ribbon recess.

3. The machine as set forth in claim 2 wherein the seventh means is activated during each tamping operation.

4. The machine as set forth in claim 3 further including an enclosed horizontally elongated hollow chamber associated with the first second and third stations and having openings accommodating the member and the third and fourth means.

5. The machine as set forth in claim 4 wherein the disc has openings which will also accommodate the member and third and fourth means, the disc being disposed in the chamber, the rotation of the disc being so timed as to permit proper movements of the member and the third and fourth means through the disc openings.

6. The machine as set forth in claim 5 wherein the sixth means includes a rotating distribution valve coupled to the fourth means and synchronized therewith.

* * * * *